US006977596B1

(12) United States Patent
Brown

(10) Patent No.: US 6,977,596 B1
(45) Date of Patent: Dec. 20, 2005

(54) FIRE EXTINGUISHER LOCATION SYSTEM

(76) Inventor: Winfield Joel Brown, 22 Irvine Rd., Old Greenwich, CT (US) 06870

( * ) Notice: Subject to any disclaimer, the term of this patent is extended or adjusted under 35 U.S.C. 154(b) by 98 days.

(21) Appl. No.: 10/409,087

(22) Filed: Apr. 9, 2003

(51) Int. Cl.[7] ..... G08B 23/00
(52) U.S. Cl. ..... 340/693.6; 340/628; 340/289; 169/60
(58) Field of Search ..... 340/289, 628, 340/692, 693.6; 169/56, 60, 23

(56) References Cited

U.S. PATENT DOCUMENTS 4,401,050 A * 8/1983 Britt et al. ..... 116/205
5,952,919 A * 9/1999 Merrill ..... 340/539.18
6,028,513 A * 2/2000 Addy ..... 340/539.16
6,124,796 A * 9/2000 Hincher ..... 340/628
6,768,424 B1 * 7/2004 Morris ..... 340/628
2004/0151430 A1 * 8/2004 Neuberger ..... 385/31

* cited by examiner

*Primary Examiner*—Jeffery Hofsass
*Assistant Examiner*—George A. Bugg

(57) ABSTRACT

A location system is provided for a fire extinguisher that identifies and locates a fire extinguisher in response to a smoke alarm. The location system is connected to the fire extinguisher to permit a user to quickly locate, find and use the fire extinguisher upon the activation of the smoke alarm. The location system may take the form of a mechanical-electrical system directly connected to the fire extinguisher or may take the form of an alerting system situated very close to the fire extinguisher or connected to the fire extinguisher for transmitting a signal via free space upon the receipt of an activation signal from the smoke alarm system. The purpose of the location system is to identify the location of the fire extinguisher for a user in response to an audio alert being generated by the smoke alarm.

3 Claims, 3 Drawing Sheets

SENSING UNIT 14

FIRE EXTINGUISHER LOCATION SYSTEM

BACKGROUND OF THE INVENTION

1. Field of the Invention

The present invention relates to fire extinguisher alarms and more particularly pertains to a new fire extinguisher location system for identifying the location of a fire extinguisher for either emergency personnel or a user in response to the activation of a smoke alarm.

2. Description of the Prior Art

The use of smoke and fire alarms are known in the prior art. Known prior art fire alarms include U.S. Pat. No. 5,952,919.

The fire extinguisher location system according to the present invention substantially departs from the conventional concepts and designs of the prior art, and in so doing provides an apparatus primarily developed for the purpose of locating the fire extinguisher in response to a smoke alarm.

SUMMARY OF THE INVENTION

In view of the obvious disadvantages inherent in not being able to locate a fire extinguisher upon the activation of a smoke alarm, the present invention provides a new fire extinguisher location system where the location of the fire extinguisher can quickly and easily be established to enable a fire extinguisher user to locate the fire extinguisher and to use the fire extinguisher upon the start of a conflagration.

As has been well documented, a fire is a very dangerous, unnerving and stressful event. The typical occupant of a house or building is likely to panic. In this time of stress it becomes difficult to locate or remember where the fire extinguisher is located. Also, other factors such as memory loss, heat and/or smoke may confuse the occupant about where is the location of the fire extinguisher. While it is important that the occupants of a burning building escape quickly and safely, it may become important for the occupant to use a fire extinguisher to easily put out a small blaze or stop the initial spread of a fire to permit others to escape the conflagration. Thus, there is a strong need and desire to locate quickly and easily the location of a fire extinguisher at the beginning of a conflagration.

To attain this, the present invention generally comprises a location system connected to the fire extinguisher that permits the potential fire extinguisher user to quickly and easily locate the fire extinguisher in an emergency situation. The location system can either provide a physical connection between the smoke alarm and the fire extinguisher or provide an audio or visual alert to identify the location of the fire extinguisher upon activation of a smoke alarm system. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fire extinguisher location system apparatus and method which has many of the advantages mentioned heretofore and many novel features that result in a new fire extinguisher location system which is not anticipated, rendered obvious, suggested, or even implied by any of the prior art smoke or fire alarms, either alone or in any combination thereof.

It is another object of the present invention to provide a new fire extinguisher location system that may be easily and efficiently manufactured and marketed.

It is a further object of the present invention to provide a new fire extinguisher location system that is of a durable and reliable construction and able to efficiently operate or be activated over long periods of time.

An even further object of the present invention is to provide a new fire extinguisher location system which is susceptible of a low cost of manufacture with regard to both materials and labor, and which accordingly is then susceptible of low prices of sale to the consuming public, thereby making such fire extinguisher alarm system economically available to the buying public.

Still yet another object of the present invention is to provide a new fire extinguisher location system which provides in the apparatuses and methods of the prior art some of the advantages thereof, while simultaneously overcoming some of the disadvantages normally associated therewith.

Even still another object of the present invention is to provide a new fire extinguisher location system that includes an alert system for generating a locating audio signal. A transmitter is situated very close or connected to the fire extinguisher for transmitting an audio signal via free space upon the receipt of an activation signal caused by the smoke or fire alarm.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
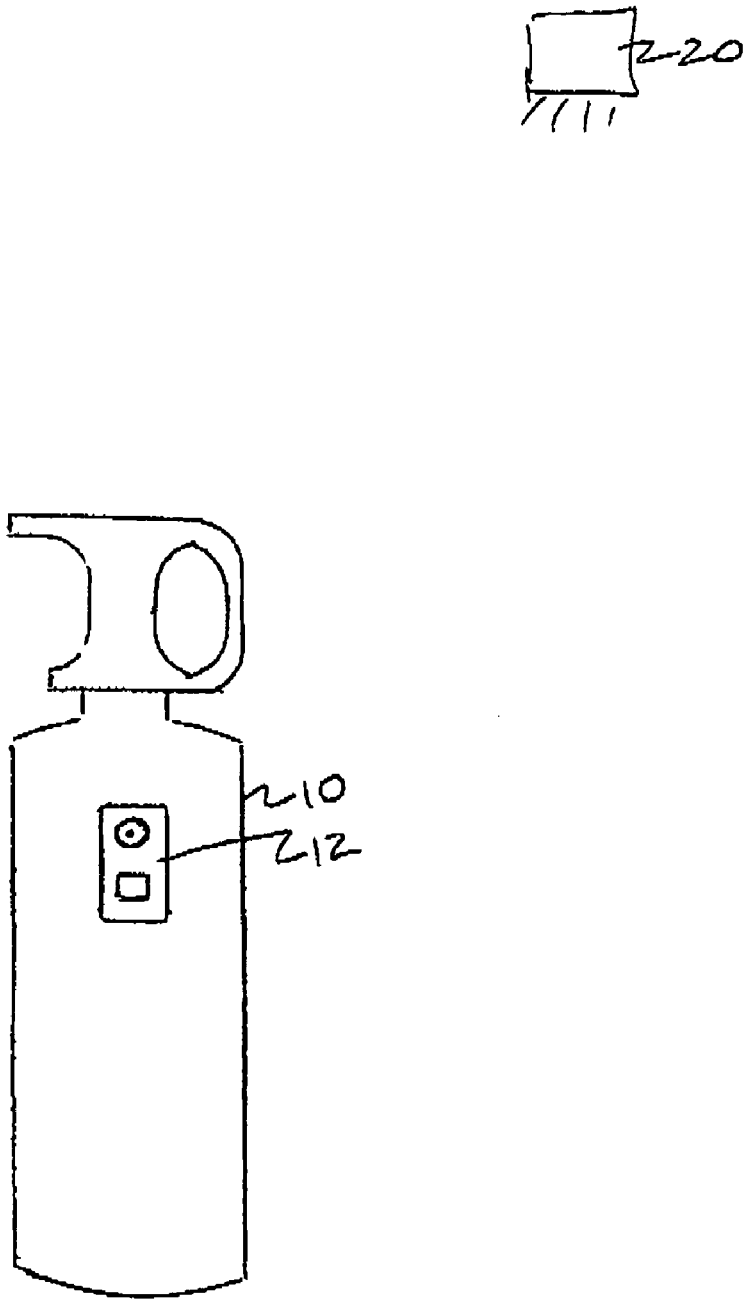
FIG. 1 is a view of a new fire extinguisher location system according to the present invention.

With reference now to the drawings, and in particular to FIGS. 1 through 5 thereof, a new fire extinguisher location system embodying the principles and concepts of the present invention and generally designated by the reference numeral 12 will be described.

Referring to FIG. 1, the present invention is a fire extinguisher location system 12 that alerts a user of the location of a fire extinguisher 10 upon the activation of a smoke or fire alarm 20. The location system 12 is physically located near or connected to the fire extinguisher 10 to provide the user the ability to find the fire extinguisher 10 in the event of a conflagration. The location system 12 first senses the alarm generated by smoke alarm 20. Then in response generates a separate but equally loud alert the permits the user to quickly and easily find the fire extinguisher 10. The smoke alarm is a commercially available unit can be readily purchased from a hardware store, such as those made by FIRST ALERT. These smoke alarm units generate a loud alarm within human auditory sensing at 3 khz. It is contemplated that the audio alert generated by location system 12 will vary in frequency and/or be distinguishable from the 3 khz of smoke alarm 20. For example, a wavering or changing audio alert from 2 khz to 3 khz would be desirable. Also a steady audio alert at a different frequency, such as 3.5 kHz, would be sufficient to locate the fire extinguisher at the same time the smoke alarm is activated.

Figure 2:
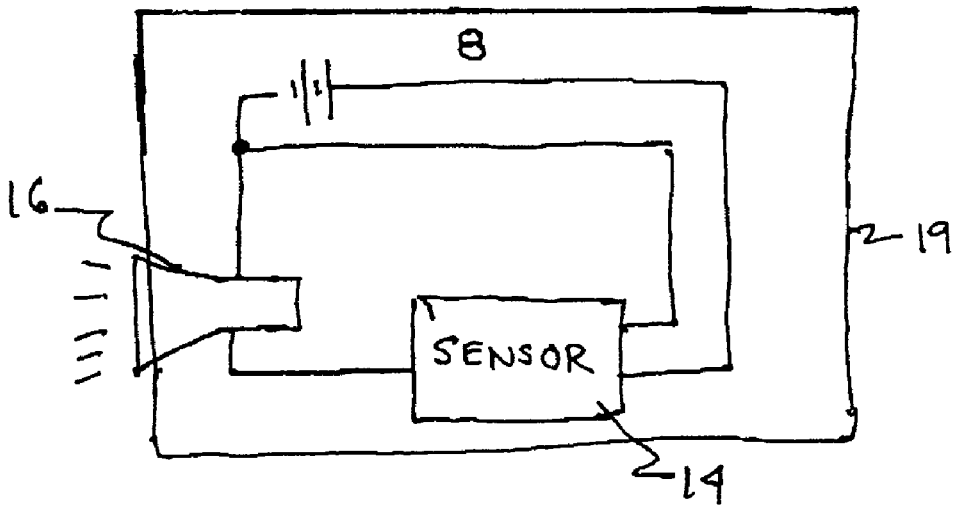
FIG. 2 is a schematic diagram of the present invention.

Referring to FIG. 2, the location system 12 is shown in greater detail. The location system 12 includes a sensing unit 14; an alert unit 16 and a power supply unit, such as battery 18. The units are included in housing 19 for protection from the environmental elements and can be easily attached to the fire extinguisher 10. The sensing unit 14 and the alert unit 16 are electrically connected to the battery 18. The battery 18, such as a one or two commercially available 9 volt batteries, is of such power as to provide long term service, such as a year or more, to the sensing unit 14.

One embodiment of location system 20 is designed to operate on one power supply 18 that provides power for sensing unit 14 and alert unit 16. In this embodiment, the sensing unit 14 sends an activation signal, such as triggering a switch to power alert unit 16 upon sensing an alarm triggered by smoke alarm unit 20 at a remote location.

Figure 3:
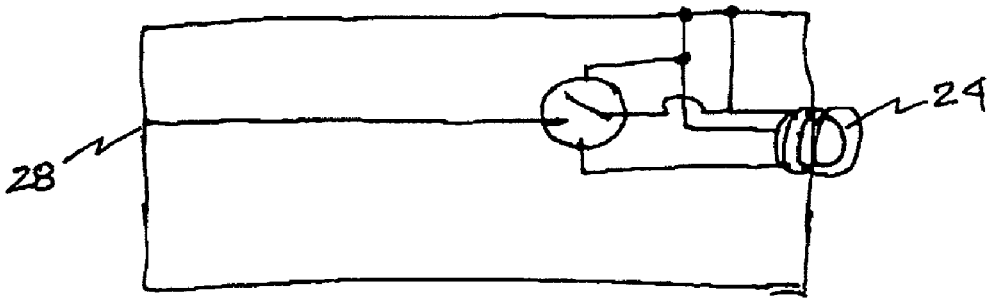
FIG. 3 is a electrical diagram of the sensing unit.

Referring to FIG. 3 this embodiment is shown in greater detail, the sensing unit 14 includes a sensor 24 and a switching mechanism 26. The sensor 24 is designed to activate switch 26 upon receiving and detecting the 3 khz audio signal of the smoke alarm 20. The sensor is a commercially available sensor available from numerous scientific equipment manufacturers. The sensor 24 is tuned to the 3 khz audio signal of the smoke alarm unit 20. Other frequencies can be employed by the sensing unit 14 depending upon the type of signal being generated by the smoke alarm unit. For home commercial use, the audio sensor is tuned to respond only to the 3 khz signal so as to minimize any false transmissions from the location system 12. The activation of switch 26 causes power from battery 18 to be provided to the alert unit 16 through electrical line 28, thus activating the alert unit 16 and permitting the transmission of an audio alert signal into free space. The audio alert signal is different than the 3 khz of the smoke alarm to notify the user the location of the fire extinguisher 10.

Figure 4:
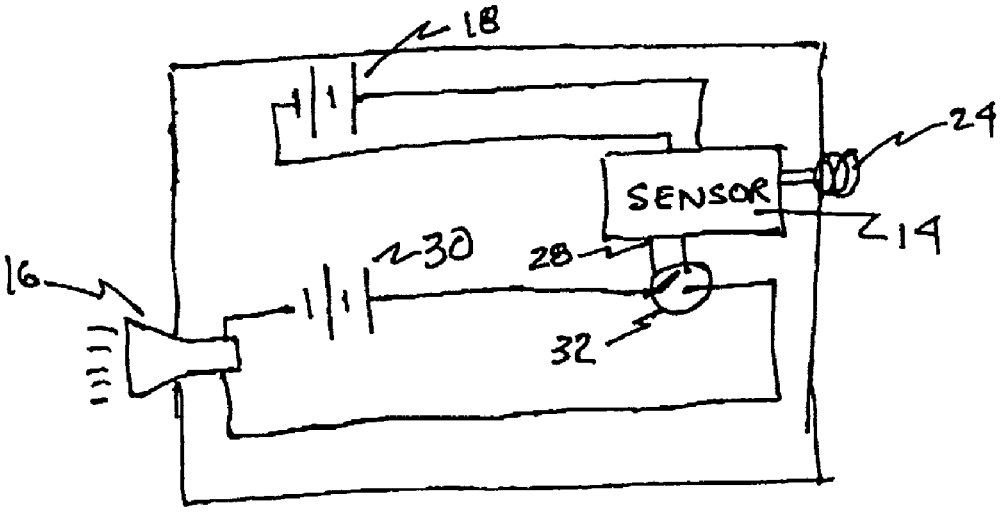
FIG. 4 is a second embodiment of the present invention showing the addition of a second power unit, such as a battery.

Referring to FIG. 4, another embodiment of the sensing unit 14 shows that the activation signal 28 from the sensor 24 is used to activate a separate power supply, such as battery 30 that is electrically connected to alert unit 16 to power only alert unit 16. Sensor 14, upon sensing the audio signal from smoke alarm 20, activates switch 32, such as a rely. Activation of switch 32 causes battery 30 to be coupled electrically to alert unit 16 to activate and power alert unit 16. The advantages of a separate battery 30 to only power alert unit 16 permits a longer maintenance time period of location system 12 and provides more power for the alert unit.

Battery 30 is advantageous from the fact that it is only used to power the alert unit 16 and thus provides a more fail-safe system. Since it is used only upon activation of alert unit 16, the life of battery 30 is equivalent to the shelf life of the battery unit that is not in use. When unused, it is common for batteries to have a shelf life of years.

Figure 5:
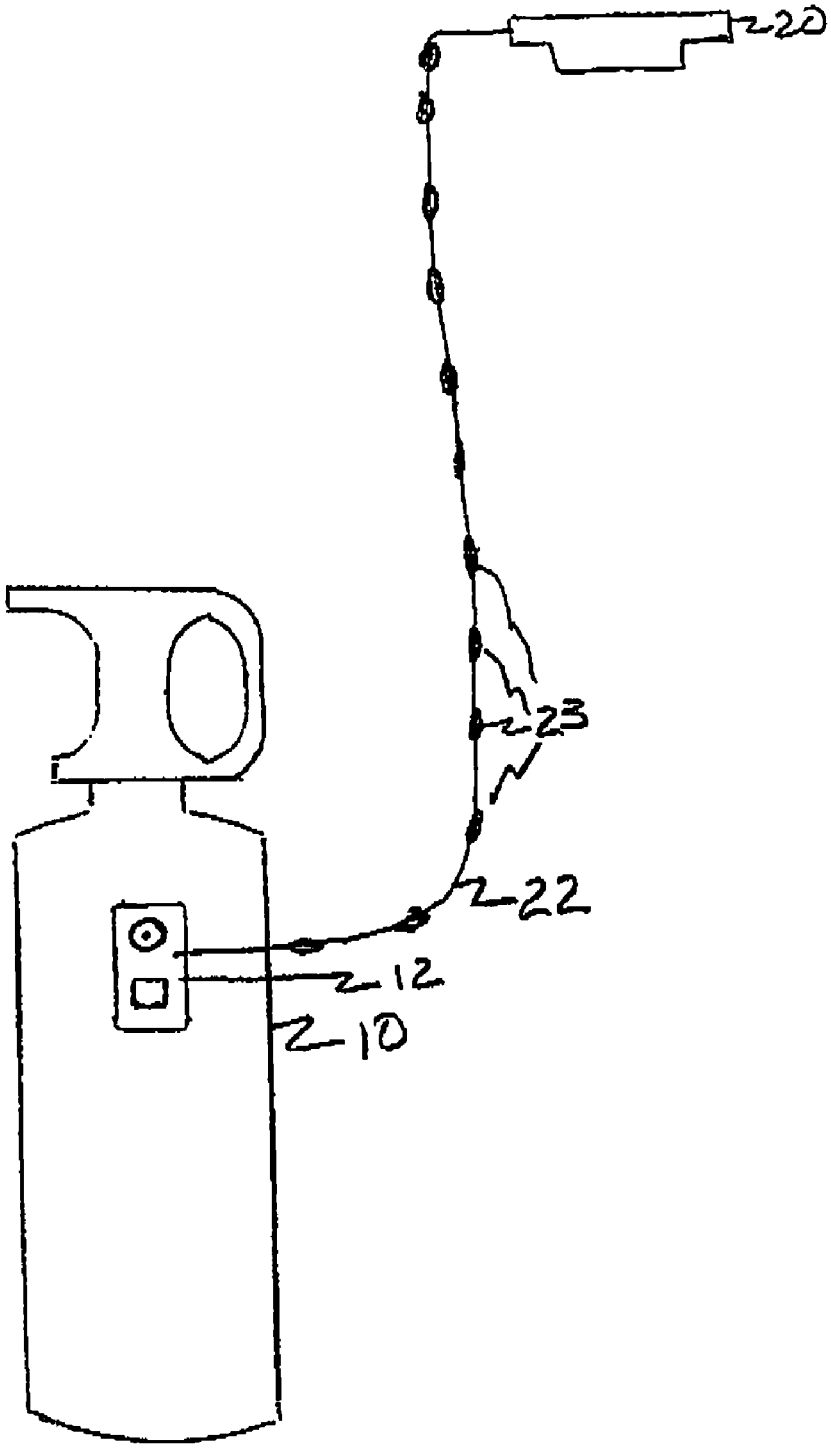
FIG. 5 is another embodiment of the alerting unit showing a visual alert.

Referring now to FIG. 5, another embodiment of location system 12 is shown. This embodiment uses touch or visual stimuli for the user to locate the fire extinguisher 10. This would be particularly beneficial for a hearing challenged user. The location system 12 includes a physically tactile medium, such as a line or lanyard 22 connected between the smoke alarm 20 and fire extinguisher 10 to provide the user with a tactile signal when the user touches the line. Upon activation of the smoke alarm 20, the fire extinguisher user is directed to the fire extinguisher 10 by following line 22. In a further refinement, line 22 includes a plurality of lights 23 that are activated by unit 12 in much the same manner as the description of alert unit 16 before and will not be repeated here. Upon activation as described above, the plurality of lights 23, such as those found on the floor of an airplane exit aisle or in a Christmas tree, pulsate or twinkle to provide the visual representation of showing the way and/or location of fire extinguisher 12. It is also possible to include in the same location system 12 the alert unit 16 and the plurality of lights 23 to provide a audio and a visual alert signal at the same time.

It should be noted that the present invention may be used in various environments including national parks, residential homes, commercial business, airplanes, boats, schools and other industrial locations.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fire extinguisher location system comprising:

a housing, a power unit, a sensing unit situated within the housing being responsive to a smoke alarm audio signal for generating and activation signal, and an alert unit consisting of (i) a physically tactile medium situated between the smoke alarm and the fire extinguisher for providing a tactile response to a user when the user transverses the space between the smoke alarm and the fire extinguisher and (ii) a plurality of lights physically situated between the smoke alarm and the fire extinguisher for transmitting a light signal via free space upon the receipt of the activation signal from the sensing unit.

2. The fire extinguisher location system of claim 1, wherein the tactile medium includes the plurality of lights to guide the user to the fire extinguisher.

3. The fire extinguisher location system of claim 2, wherein the tactile medium consists of a lanyard.

* * * * *